US006874678B2

(12) United States Patent
Prokosch et al.

(10) Patent No.: US 6,874,678 B2
(45) Date of Patent: Apr. 5, 2005

(54) SHIPPING AND DISPLAY CONTAINER

(75) Inventors: Mark D. Prokosch, Westmont, NJ (US); Lawrence R. Thornton, Bridgewater, NJ (US); Andy Edelman, Haddonfield, NJ (US); Mitchell Edelman, Cherry Hill, NJ (US); John C. Pender, Jamison, PA (US)

(73) Assignee: International Paper Company, Stamford, CT (US)

( * ) Notice: Subject to any disclaimer, the term of this patent is extended or adjusted under 35 U.S.C. 154(b) by 91 days.

(21) Appl. No.: 10/052,748

(22) Filed: Jan. 23, 2002

(65) Prior Publication Data

US 2003/0136821 A1 Jul. 24, 2003

(51) Int. Cl.[7] ..... B65D 5/72

(52) U.S. Cl. ..... 229/122.1; 229/120.15; 206/783

(58) Field of Search ..... 229/162.3, 163, 229/120.15, 103.2; 816/123; 206/459.5, 831, 783

(56) References Cited

U.S. PATENT DOCUMENTS

| | | | | | |
|---|---|---|---|---|---|
| 1,943,074 | A | * | 1/1934 | Heyman | 229/125.38 |
| 2,012,131 | A | | 8/1935 | Kondolf | |
| 2,359,679 | A | * | 10/1944 | Roehrl | 206/758 |
| 2,595,202 | A | * | 4/1952 | Pardee | 229/120.15 |
| 2,799,391 | A | * | 7/1957 | Eisner | 206/232 |
| 2,866,588 | A | * | 12/1958 | Bolding | 229/120.15 |
| 2,964,230 | A | | 12/1960 | Nemoede | |
| 3,062,430 | A | * | 11/1962 | Rutledge | 206/459.5 |
| 3,107,039 | A | | 10/1963 | Painter | |
| 3,211,359 | A | | 10/1965 | Fickes | |
| 3,214,075 | A | * | 10/1965 | Champlin et al. | 206/459.5 |
| 3,219,253 | A | * | 11/1965 | Davis | 206/45.28 |
| 3,229,889 | A | | 1/1966 | Vrana | |
| 3,664,572 | A | * | 5/1972 | Puchkoff et al. | 229/103.2 |
| 3,675,763 | A | * | 7/1972 | Sandel | 229/120.15 X |
| 3,804,321 | A | | 4/1974 | Forbes, Jr. | |
| RE28,530 | E | * | 8/1975 | D'Alessio | 206/459.5 |
| 3,945,557 | A | | 3/1976 | Graham, Jr. | |
| 4,108,350 | A | * | 8/1978 | Forbes, Jr. | 206/758 |
| 4,117,972 | A | | 10/1978 | Sellors | |
| 4,307,806 | A | * | 12/1981 | Haubert | 206/232 |
| 4,903,892 | A | * | 2/1990 | McNair et al. | 229/120.15 X |
| 5,096,058 | A | * | 3/1992 | Juravin et al. | 206/232 |
| 5,232,087 | A | * | 8/1993 | Schluger | 206/45.29 |
| 5,293,994 | A | * | 3/1994 | Antik | 206/387.1 |
| 5,337,948 | A | | 8/1994 | Newsome et al. | |
| 5,657,872 | A | | 8/1997 | Leftwich et al. | |
| 5,722,584 | A | * | 3/1998 | Fujiwara | 229/120.15 |
| 5,791,487 | A | * | 8/1998 | Dixon | 206/758 |
| 6,050,402 | A | | 4/2000 | Walter | |
| 6,070,719 | A | * | 6/2000 | Pollock | 206/459.5 |

* cited by examiner

*Primary Examiner*—Tri M. Mai
(74) *Attorney, Agent, or Firm*—Melvin D. Fletcher

(57) ABSTRACT

The carton has a front panel provided with a dispensing opening. Partitions extend from an inner back panel to organize the contents of the container. A shelf is formed at the bottom edge of the dispensing opening to facilitate the dispensing of the contents. A cover panel extends over the front panel and provides protection for the contents during shipping. For display and dispensing purposes, the cover panel is removed to create a suitable display container.

17 Claims, 2 Drawing Sheets

SHIPPING AND DISPLAY CONTAINER

BACKGROUND OF THE INVENTION

Cardboard boxes are widely used to ship goods between manufacturers, distributors and retailers. A cardboard box is an inexpensive package providing protection for the goods and made in any variety of sizes. There is often a desire to provide a cardboard box used not only to ship the goods from one place to another, but used at the point of sale in a display capacity.

The prior art discloses many types of boxes that are convertible from shipping to display functions. One such prior art container is disclosed in U.S. Pat. No. 5,657,875, issued to Leftwich et al. The container disclosed by Leftwich et al has removable front, top and back panels to create easy access to the contents. Access is further enhanced by removable portions of the panels underlying the panels that are removed. Kondolf, U.S. Pat. No. 2,012,131, discloses a carton having a bottom panel 20 and an inner bottom panel 21 having dividers 40, 41 cut and folded upwardly from the inner bottom panel 21. The dividers serve to organize the contents of the carton.

There is a need for a cardboard box serving as a shipping container and a display container with structure to organize and dispense the contents at the point of sale.

It is an object of the invention to provide a shipping container that is of sturdy construction to protect the contents of the container.

It is another object of the invention to provide a carton with a dispensing opening in a front panel and dividers formed within the container to organize the contents.

It is yet another object of the invention to provide a container that can perform the multiple functions of shipping, displaying and dispensing.

It is yet another object of the invention to provide a container that is inexpensive and useable at all points between the manufacture and retailer.

These and other objects of the invention will become apparent after reading the description of the invention.

SUMMARY OF THE INVENTION

The carton has a front panel provided with a dispensing opening. Partitions extend from an inner back panel to organize the contents of the container. A shelf is formed at the bottom edge of the dispensing opening to facilitate the dispensing of the contents. A cover panel extends over the front panel and provides protection for the contents during shipping. For display and dispensing purposes, the cover panel is removed to create a suitable display container.

DETAILED DESCRIPTION OF THE INVENTION

Figure 1:
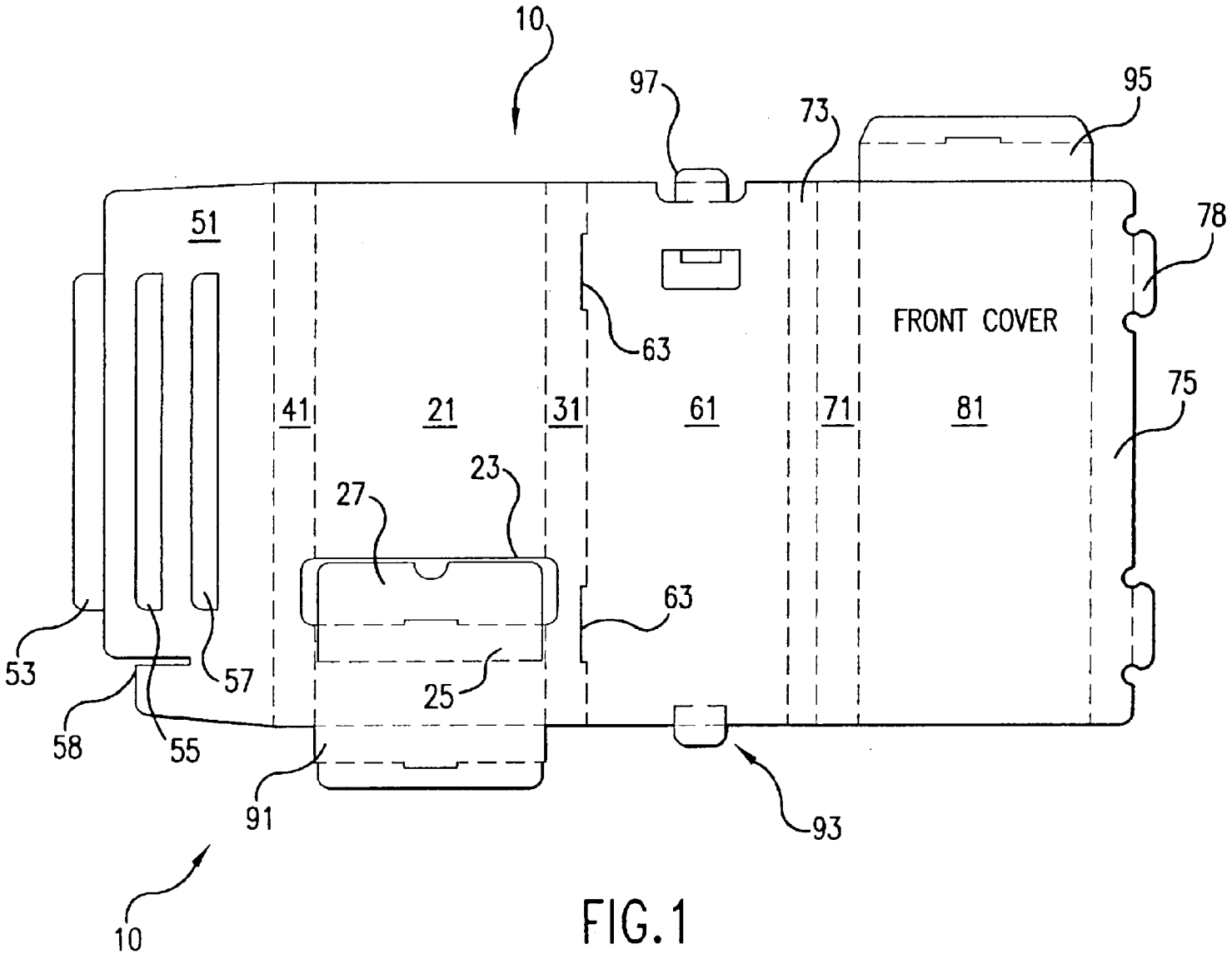
FIG. 1 depicts the blank used to make the container of the invention.

Referring to FIG. 1, the blank for making the shipping container 10 can be seen. An inner back panel 51 has fold-up dividers 53, 55, 57. The first divider 53 is connected to the edge of the inner back panel 51 and the second and third dividers 55, 57 are cut from the panel 51 and can be folded upwardly to a position perpendicular to the inner back panel 51. Of course, more than three dividers can be formed in the inner back panel 51. A notch is formed in the free edge of the inner back panel 51 whose function will be explained later.

A right side panel 41 is foldably connected between the inner back panel and front panel 21. The front panel 21 has a dispensing opening 23. Within the dispensing opening is a first shelf panel 25 and second shelf panel 27 whose operation will be explained later. A bottom closure panel 91 is foldably connected to the bottom edge of the front panel 21. Any conventional bottom panel may be used with the carton.

A left side panel 31 is foldably connected between the front panel 21 and an outer back panel 61. A tab 93 is connected along the bottom edge of the outer back panel 61 for securing the bottom panel 91 in the closed position. A linking panel 71 foldably joins the outer back panel 61 to the front cover 81. A tear seam 73 is formed within the linking panel 71 by a pair of spaced perforation lines. Any conventional means can be used for forming a line of weakness so that the front cover may eventually be separated from the rest of the blank.

A top panel 95 is connected to the top edge of the front cover panel 81 and cooperates with a tab 97 connected to the top edge of the outer back panel 61 to close the top of the container. A connector panel 75 is connected to the edge of the cover panel 81 opposite the connector panel 71. The connector panel 75 is provided with tab 78 that engages slot 63 formed at the fold line between the outer back panel 61 and left side panel 31 when the blank is folded into the container.

To fold the blank into the carton, the left panel 31 and right panel 41 are folded to extend away from the front panel 21 and the inner back panel 51 is folded to be substantially parallel to the front panel 21. The outer back panel 61 is folded to overlie the inner back panel 51. The inner back panel 51 is not as wide as either the front panel 21 or outer back panel 61 so that when the first divider panel 53 is folded upwardly to form a divider, it is spaced from the sides of the container. The front cover panel wraps about the carton and overlies the front panel 21 as the linking panel 71 covers the right side panel 41. To complete the carton in its assembled state, the connector panel 75 overlies the left side panel 31 and the tabs 78 engage and are retained by the slot 63. Fully assembled, the container is used for shipping goods from place to place until it reaches the final destination at which time it is converted into its display configuration.

Figure 2:
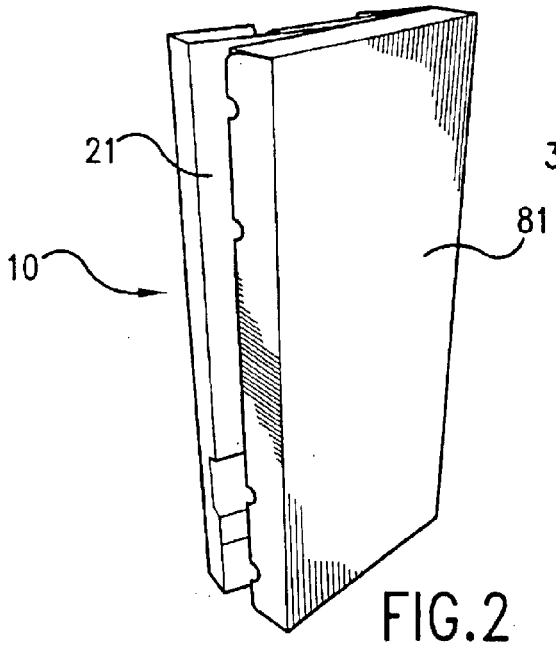
FIG. 2 is a view of the container with the cover panel partially open.

To convert the container to its shipping display, the front cover is opened and removed. The first step in achieving this conversion is shown in FIG. 2 where the tabs 78 have been disengaged from the notches 63 and the cover panel 81 is separated from the front panel 21.

Figure 3:
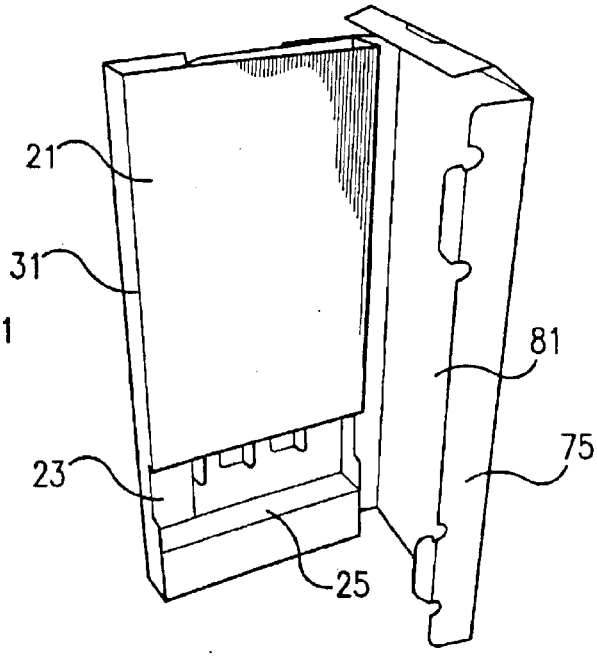
FIG. 3 is a view of the container with the cover panel fully open.
Figure 4:
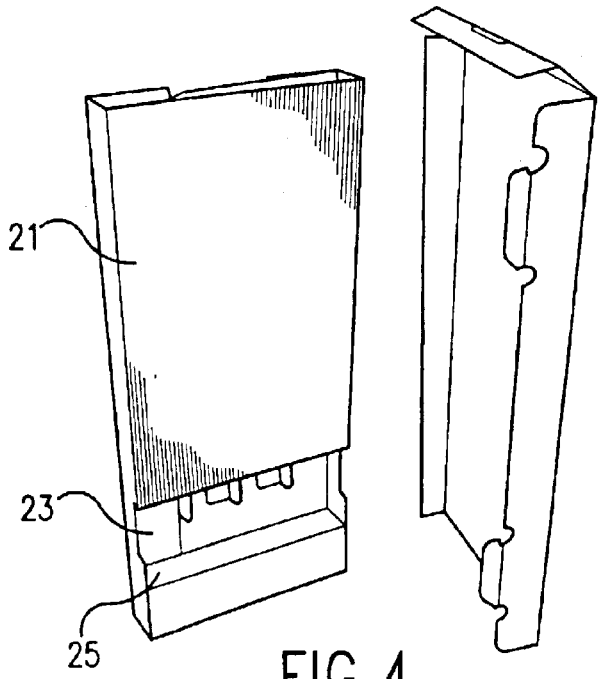
FIG. 4 is a view of the container with the cover panel removed.
Figure 5:
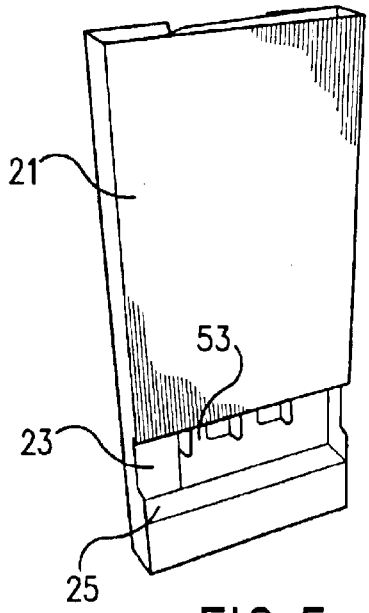
FIG. 5 is a view of the container in its display/dispensing configuration.

Once disengaged, the front panel can be folded completely open to position away from the container as shown in FIG. 3. With the cover panel 81 out of the way, the dispensing opening and shelf can be formed. The dispensing opening and shelf are formed by folding the first shelf panel 25 downwardly to be parallel to the bottom closure 91. A tab formed between the first shelf panel 25 and second shelf panel 27 engages the notch 58 formed in the inner back panel 51 to maintain the shelf in place. The second shelf panel 27 may be removed or folded against the inner back panel 51. The front cover can then be removed by tearing along the tear seam 73 as shown in FIG. 4. Once the cover panel has been removed and the shelf formed, the carton is in a display configuration with a gravity feed of the contents to the dispensing opening 23.

While the invention has been disclosed with reference to a preferred embodiment, variations and modifications would be apparent to one of ordinary skill in the art and the invention encompasses such variations and modifications.

We claim:

1. A blank for a container, comprising:

an inner back panel;

a first side panel foldably connected to said inner back panel along a first fold line;

a front panel foldably connected to said first side panel along a second fold line;

a second side panel foldably connected to said front panel along a third fold line;

an outer back panel foldably connected to said second side panel along a fourth fold line;

a connector panel foldably connected to said outer back panel along a fifth fold line;

a cover panel foldably connected to said connector panel along a sixth fold line;

said first fold line being parallel to said fourth fold line, a dispensing opening formed in said front panel, a shelf formed below said dispensing opening, and a notch formed in said inner back panel in an edge opposite said first side panel.

2. The blank of claim 1, wherein said second fold line is parallel to said sixth fold line.

3. The blank of claim 1, further comprising divider panels formed by cut lines in said inner back panel.

4. The blank of claim 1, further comprising a divider extending from an edge of said inner back panel by a seventh fold line.

5. The blank of claim 1, wherein said outer back panel is wider than said inner back panel.

6. The blank of claim 1, further comprising a line of weakness in said connector panel.

7. The blank of claim 6, wherein said line of weakness is a tear seam.

8. The blank of claim 1, further comprising a top closure connected to a top edge of said blank and a bottom closure connected to a bottom edge of said blank.

9. A carton comprising:

a front panel;

a first side panel and a second side panel connected to said front panel by fold lines;.

an inner back panel connected to said first side panel by a fold line;

an outer back panel connected to said second side panel by a fold line and overlying said inner back panel and a connector panel connected to said outer back panel by a fold line and overlying said first side panel;

a cover panel connected to said connector panel by a fold line and overlying said front panel, and a dispensing opening in said front panel, a shelf at the bottom of said dispensing opening, said shelf foldably connected to the bottom edge of said dispensing opening and extending toward said inner back panel, and a notch in said inner back panel, said notch forming an edge for supporting said shelf.

10. The carton of claim 9, further comprising a line of weakness in said connector panel.

11. The carton of claim 10, wherein said line of weakness is a tear seam.

12. A carton comprising:

a front panel having a left edge and a right edge;

a first side panel and a second side panel connected to said front panel by fold lines;

an inner back panel connected to said first side panel by a fold line;

an outer back panel connected to said second side panel by a fold line and overlying said inner back panel and a connector panel connected to said outer back panel by a fold line and overlying said first side panel; and a cover panel connected to said connector panel by a fold line and overlying said front panel, and at least one divider panel folded from said inner back panel, said at least one divider panel spaced from said front panel left edge and right edge.

13. The carton of claim 9, wherein said outer back panel is wider than said inner back panel.

14. The carton of claim 12, wherein said at least one divider panel is connected to an edge of said inner back panel by a fold line.

15. The carton of claim 12, wherein said at least one divider panel is formed by a cut line joining a fold line in said inner back panel.

16. The carton of claim 12, wherein said at least one divider panel is laterally spaced from said first side panel.

17. The carton of claim 12, wherein said at least one divider panel comprises two divider panels, a first divider panel connected to an edge of said inner back panel by a fold line and a second divider panel formed by a cut line joining a fold line in said inner back panel.

* * * * *